United States Patent [19]

Seilly

[11] 4,236,837

[45] Dec. 2, 1980

[54] OPERATING MECHANISM FOR A DOT MATRIX PRINTER

[75] Inventor: Alec H. Seilly, North Wembley, England

[73] Assignee: Lucas Industries Limited, Birmingham, England

[21] Appl. No.: 28,896

[22] Filed: Apr. 10, 1979

[30] Foreign Application Priority Data

Apr. 14, 1978 [GB] United Kingdom ..... 14677/78

[51] Int. Cl.[3] ..... B41J 3/12

[52] U.S. Cl. ..... 400/124; 101/93.05

[58] Field of Search ..... 400/124; 101/93.05, 101/93.34, 93.48; 335/258, 274

[56] References Cited

U.S. PATENT DOCUMENTS

| | | | |
|---|---|---|---|
| 3,333,667 | 8/1967 | Nordin | 400/124 |
| 3,770,092 | 11/1973 | Grim | 400/124 |
| 3,973,661 | 8/1976 | DeBoo et al. | 400/124 |

*Primary Examiner*—Paul T. Sewell

[57] ABSTRACT

A dot matrix printer comprises an armature connected to a pin, the end of the pin in use, engaging the surface of a paper tape. A preloaded spring is provided to act upon the armature and electromagnetic means is provided and which when energized move the armature against the action of the spring. The armature when the electromagnetic means is de-energized, moves under the action of the spring so that the armature and pin move towards paper. The extent of travel of the armature under the direct action of the spring is limited whereby the inertia only of the armature and the pin causes the impact of the pin with the paper.

3 Claims, 3 Drawing Figures

OPERATING MECHANISM FOR A DOT MATRIX PRINTER

This invention relates to an operating mechanism for use with a so called dot matrix printer.

In a dot matrix printer a sheet of paper is moved past a marking head which contains a number for example seven, of wires or pins arranged in a row extending transverse to the movement of the paper whilst a character is being created. When it is required to create a character a selected one or ones of the wires or pins are moved forward to impact with the paper to cause a mark to appear thereon and as the paper is moved past the marking head, the character is built up as a pattern of dots by causing other combinations of the wires or pins to impact the paper.

It is clear that the rate at which the character can be built up depends upon the rate of movement of the paper but by far the more important is the rate at which the wires or pins can be moved. If the paper moves more quickly than the wires or pins can function then the character produced will be elongated in the direction of travel of the paper.

It has been the practice to effect movement of the wire or pin by an electromagnet which when energised causes an armature connected to the wire or pin to move. A return spring is required to return the wire or pin and the armature, when the electromagnet is de-energised.

The object of the present invention is to provide an operating mechanism for the purpose specified in a form which will permit of an increased speed or operation.

According to the invention an operating mechanism for a dot matrix printer comprises an armature, a wire or pin secured to the armature for movement therewith, a preloaded spring for acting on the armature, and electromagnetic means which when energised moves the armature against the action of said spring, the armature when the electromagnetic means is de-energised, moving under the action of said spring so that the wire or pin moves toward the paper, the extent of travel of the armature under the action of the spring, being limited whereby the inertia only of the armature and the wire or pin causes the impact of the wire or pin with the paper.

According to a further feature of the invention, a light return spring is provided to return the armature and the wire or pin to an initial position.

According to a further feature of the invention, the operating mechanism is located within a housing which contains guideways for the wires or pins, said housing being finned for dissipation of heat generated by the electromagnetic means.

Figure 1:
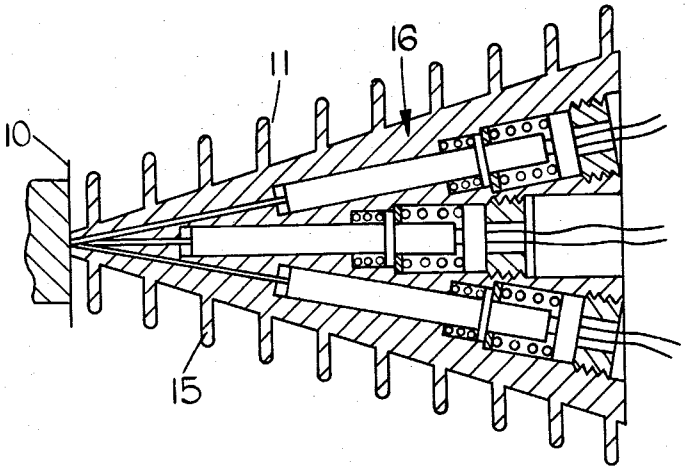
Figure 2:
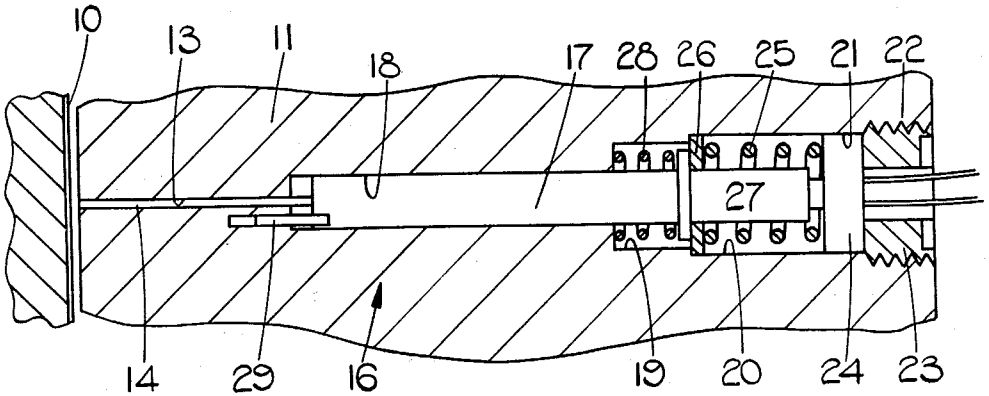
Figure 3:
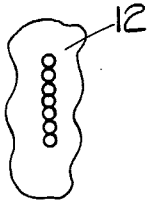

An example of a portion of a matrix printer which incorporates an operating mechanism in accordance with the invention will now be described with reference to the accompanying drawings in which:

FIG. 1 is a section through the housing of the printer showing the disposition of three individual mechanisms for operating respective wires or pins, FIG. 2 is an enlarged view of a portion of the printer seen in FIG. 1, FIG. 3 is an end view of the housing.

Referring to the drawings, the matrix printer includes means (not shown), which supports a piece of paper indicated at 10 for movement past a housing 11, which in use is disposed adjacent the paper. The housing has a face 12 which is spaced from the paper and in which is formed a series of apertures in the particular example seven, through which can extend wires or pins for impact with the sheet of paper. The paper is of a special type so that a mark is made on the paper when it is impacted by a wire or pin. In the particular example the housing 11 contains guide ways 13 for wires 14 which extend through the aforesaid apertures, the apertures in effect constituting the ends of the guide ways. In the rest position of the wires 14 and in the de-energised state of the electromagnetic means as will be described, the wires lie flush with the surface 12 of the housing.

As will be seen from FIG. 1 the housing is of generally conical form and it is provided with fins 15 which facilitate the dissipation of heat which is created by electromagnetic means within the housing as will be described.

The housing contains in the particular example, seven operating mechanisms generally indicated at 16, for the wires respectively. The operating mechanisms are of elongated form and six of the mechanisms are disposed in a generally circular fashion within the housing, the seventh such mechanism being generally centrally disposed.

Turning now to FIG. 2 each operating mechanism 16 includes an armature 17 which is slidable within a stepped bore 18 formed in the housing. The associated guide way 13 extends into the narrower end of the bore 18 and the bore has a first enlarged portion 19 a second enlarged portion 20, a third enlarged portion 21 and a fourth enlarged portion 22. The enlarged portion 22 is provided with an internal screw thread for the reception of a plug 23 which acts to retain the operating mechanism within the bore. The enlarged portion 21 contains a support 24 which is held in position against the adjacent step by means of a plug 23. The support 24 carries a solenoid which extends within the armature 17.

The enlarged portion 20 of the bore accommodates a preloaded coiled compression spring 25 which at one end bears against the support 24 and which at its other end bears against an annular abutment ring 26 and urges this ring into contact with the step defined between the portions 19 and 20 of the bore. As stated the spring 25 is preloaded, this being effected when the plug 23 is tightened.

Mounted on the armature 17 is an abutment 27 which is in the form of a ring. Moreover, the first enlargement 19 of the bore 18 accommodates a light coiled compression spring 28 which is interposed between the adjacent step defined between the portion 19 of the bore and the narrower portion of the bore, and the abutment 27.

Finally means in the form of a pin 29 is provided on the armature and is located within a bore formed in the housing to prevent rotation of the armature 17 in use.

In operation, when the solenoid is de-energised, the parts assume the position shown in FIG. 2. As will be observed, the wire 14 is flush with the surface 12 and the abutment 27 is held in engagement with the abutment ring 26 by the spring 28. No force is exerted by the spring 25 on the armature. When the solenoid is energised the armature 17 is moved towards the right as seen in FIG. 2, and during such movement the abutment ring 26 is lifted away from the step and the spring 25 is slightly compressed. Moreover, the end of the wire 14 is retracted from the surface 12.

When the solenoid is de-energised, the spring 25 urges the armature together with the wire 14 towards the left. The force which is applied by the spring 25 on the armature ceases to be applied when the abutment ring 26 contacts the step. During the movement however, the armature and the wire will have gained some kinetic energy and it is this energy which drives the armature forward against the action of the spring 28 and drives the free end of the wire into contact with the papers. A mark is thus made upon the paper and then the armature is retracted. This can be achieved by means of the spring 28 but it is more likely to be achieved by the combined action of the spring 28 and the force exerted when the solenoid is re-energised.

It is anticipated that the spring 28 may be omitted because as mentioned above, the force exerted by the armature can be utilised to withdraw the wire from the paper once impact has occured. It is possible however, that the paper itself will exert sufficient reaction on the end of the wire to return the wire so that its free end will lie flush with the surface 12.

It is evident that if for example all the solenoids are de-energised at the same time as may occur for instance if one vertical of the letter "H" is being created, the housing will be subject to considerable reaction force. It must therefore be very rigidly mounted so that it does not move under the spring reaction.

In some dot matrix printers several sheets of paper may be printed at the same time and it may be necessary to adjust the base 12 of the housing relative to the reaction surface (not shown) which supports the paper 10. For this purpose the housing may be mounted on a support or about a pivot so that the distance between the reaction surface and the face 12 can be adjusted. The housing may be lightly spring loaded towards the reaction surface and a one way clutch provided between the housing and the support to prevent movement of the housing under the spring reaction as described above. Clearly when the gap does require to be adjusted, the clutch must be released. The clutch may be a roller clutch or it may be a plate clutch which is only locked when the spring has urged the housing to the desired position. Alternatively, the housing might be mounted on a slide and a screw adjuster provided to set the space between the face 12 and the aforesaid reaction face.

An alternative arrangement is to lightly spring load the housing towards the reaction surface and to resist movement of the housing under the action of the reaction force, by means of an hydraulic damping arrangement. With such an arrangement it would be possible for the spring force to be applied to the housing by way of the hydraulic damping arrangement. One way of doing this is to provide a pair of chambers which are interconnected by a fluid connection, each of the chambers having an open end closed by a diaphragm. One of the diaphragms engages the housing whilst the other diaphragm is engaged by a light spring. A one way valve is provided in the connection between the two chambers such as to permit transfer of fluid due to the force exerted by the spring. The one way valve however, will close when the reaction force occurs and if desired, a slow bleed orifice may be connected in parallel with the one way valve to permit the housing to be moved away from the paper when required.

It is clear that the electromagnetic means must be designed to provide sufficient force to compress the spring 25. A suitable form of such a device is described in the specification of British Pat. No. 1,504,873. Briefly, however, the internal peripheral surface of the armature is provided with a two start helical thread which defines a pair of spaced helical ribs. The solenoid is provided with similar ribs on its peripheral surface and the grooves defined between the ribs accommodate electrical windings, the direction of current flow in the windings in the two grooves being in the opposite direction so that the ribs on the solenoid assume opposite magnetic polarity when the windings are energised. The ribs on the armature extend into the grooves on the solenoid and when the windings are energised, the ribs on the armature move towards the ribs on the solenoid.

The speed of operation of the operating device described above does depend upon the travel required of the wire which contacts the paper and clearly as the distance the wire is required to move increases so the frequency of operation must decrease. When a number of sheets are required to be impacted then the movement of the wire will be increased and therefore the frequency of operation will be decreased.

In a practical example the outer diameter of the armature is 6.0 mm with the wall thickness of the armature 0.1 mm and the diameter between the crest of the ribs on the armature 4.8 mm. The pitch of the ribs on the armature and also the solenoid is 2.0 mm giving a 4.0 mm lead. The root thickness of the ribs is 0.2 mm. The root diameter of the solenoid is 2.0 mm and the crest diameter 5.2 mm. The crest width of the ribs on the solenoid is 0.2 mm and the root width of the ribs 0.5 mm. The winding comprises 63 turns of 38 SWG wire operated from a 40 volt supply, the resistance of the winding being approximately 14 ohms. Mild steel can be utilised for both the armature and the solenoid although if higher speeds are required special alloys can be used particularly for the solenoid.

I claim:

1. An operating mechanism for a dot matrix printer comprising a housing defining a stepped bore, an armature slidable within a first part of the bore, a pin secured to the armature for movement therewith, an abutment defined on the armature, a preloaded spring located within an enlarged second portion of the bore and surrounding the armature for acting on the armature, an abutment ring surrounding the armature and engaged by one end of the preloaded spring to urge the abutment ring into contact with a step defined at one end of the second portion of the bore, said step acting to limit the extension of the preloaded spring, and electromagnetic means which when energized moves the armature against the action of said spring, the armature when the electromagnetic means is de-energized, moving under the action of said spring so that the pin moves toward a paper, the extent of travel of the armature under the action of the spring being limited whereby the inertia only of the armature and pin causes the impact of the pin with the paper.

2. A mechanism according to claim 1 including a light return spring for returning the armature and the pin to an initial position.

3. A mechanism according to claim 2 in which said return spring is located within a third portion of the bore intermediate said first and second portions of the bore, said return spring surrounding the armature and being located between said abutment and a step defined between the first and third portions of the bore.

* * * * *